US010062278B2

(12) United States Patent
Maier et al.

(10) Patent No.: US 10,062,278 B2
(45) Date of Patent: Aug. 28, 2018

(54) MANAGEMENT OF A PARKING LOT

(71) Applicant: Robert Bosch GmbH, Stuttgart (DE)

(72) Inventors: Manuel Maier, Esslingen (DE); Juergen Auracher, Oberstenfeld (DE); Stefan Nordbruch, Kornwestheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 15/572,437

(22) PCT Filed: May 12, 2016

(86) PCT No.: PCT/EP2016/060634
§ 371 (c)(1),
(2) Date: Nov. 7, 2017

(87) PCT Pub. No.: WO2016/202503
PCT Pub. Date: Dec. 22, 2016

(65) Prior Publication Data

US 2018/0122232 A1 May 3, 2018

(30) Foreign Application Priority Data

Jun. 17, 2015 (DE) ..... 10 2015 211 114

(51) Int. Cl.
*G08G 1/01* (2006.01)
*G08G 1/065* (2006.01)
*G08G 1/14* (2006.01)

(52) U.S. Cl.
CPC ..... *G08G 1/065* (2013.01); *G08G 1/142* (2013.01)

(58) Field of Classification Search
CPC ..... G08G 1/065
USPC ..... 340/933
See application file for complete search history.

(56) References Cited

U.S. PATENT DOCUMENTS

| | | | | |
|---|---|---|---|---|
| 3,079,077 | A | 2/1963 | Bolton | |
| 3,141,612 | A | 7/1964 | Bolton | |
| 5,432,508 | A * | 7/1995 | Jackson | E04H 6/42 340/932.2 |
| 6,342,845 | B1 * | 1/2002 | Hilliard | G08G 1/015 340/933 |
| 6,426,708 | B1 * | 7/2002 | Trajkovic | G08G 1/14 340/932.2 |
| 6,917,307 | B2 * | 7/2005 | Li | G08G 1/14 194/902 |

(Continued)

FOREIGN PATENT DOCUMENTS

| | | |
|---|---|---|
| EP | 2447927 A1 | 5/2012 |
| WO | 2006/086831 A1 | 8/2006 |

OTHER PUBLICATIONS

International Search Report dated Aug. 24, 2016, of the corresponding International Application PCT/EP2016/060634 filed May 12, 2016.

*Primary Examiner* — Santiago Garcia
(74) *Attorney, Agent, or Firm* — Norton Rose Fulbright US LLP; Gerard Messina

(57) ABSTRACT

A parking lot is set up for the parking of motor vehicles. A method for managing the parking lot includes steps of determining a maximum number of motor vehicles able to be parked in the parking lot, of counting of arriving and departing motor vehicles, of determining a number of motor vehicles parked in the parking lot on the basis of the counted motor vehicles, and of determining a number of motor vehicles that are additionally able to be parked in the parking lot.

9 Claims, 1 Drawing Sheet

(56) References Cited

U.S. PATENT DOCUMENTS

| | | | | |
|---|---|---|---|---|
| 8,390,477 | B2 * | 3/2013 | Noel, II | G08G 1/14 340/568.1 |
| 8,698,652 | B1 | 4/2014 | Zhang | |
| 8,791,838 | B2 * | 7/2014 | Scofield | G01C 21/34 340/932.2 |
| 9,666,075 | B2 * | 5/2017 | Davies | G08G 1/149 |
| 9,847,027 | B2 * | 12/2017 | Nordbruch | G08G 1/146 |
| 9,870,648 | B2 * | 1/2018 | Moran | G07B 15/02 |
| 2007/0050240 | A1 * | 3/2007 | Belani | G06Q 30/0284 705/13 |
| 2008/0203145 | A1 * | 8/2008 | Martins | G06Q 20/20 235/375 |
| 2012/0284209 | A1 | 11/2012 | Duffy et al. | |
| 2014/0062726 | A1 * | 3/2014 | Aivas | G08G 1/146 340/932.2 |
| 2014/0122190 | A1 | 5/2014 | Wolfson et al. | |
| 2014/0145862 | A1 | 5/2014 | Wang et al. | |
| 2014/0266803 | A1 | 9/2014 | Bulan et al. | |
| 2014/0372185 | A1 | 12/2014 | Ganot | |
| 2015/0138001 | A1 * | 5/2015 | Davies | G08G 1/149 340/932.2 |
| 2016/0140846 | A1 * | 5/2016 | Outwater | G08G 1/144 340/932.2 |
| 2016/0189545 | A1 * | 6/2016 | York | G08G 1/14 701/414 |
| 2016/0371609 | A1 * | 12/2016 | Nordbruch | G06Q 10/02 |
| 2016/0371978 | A1 * | 12/2016 | Nordbruch | G08G 1/141 |
| 2017/0032583 | A1 * | 2/2017 | Moran | G06F 17/30864 |
| 2017/0249625 | A1 * | 8/2017 | Vossoughi | G06Q 20/3223 |

* cited by examiner

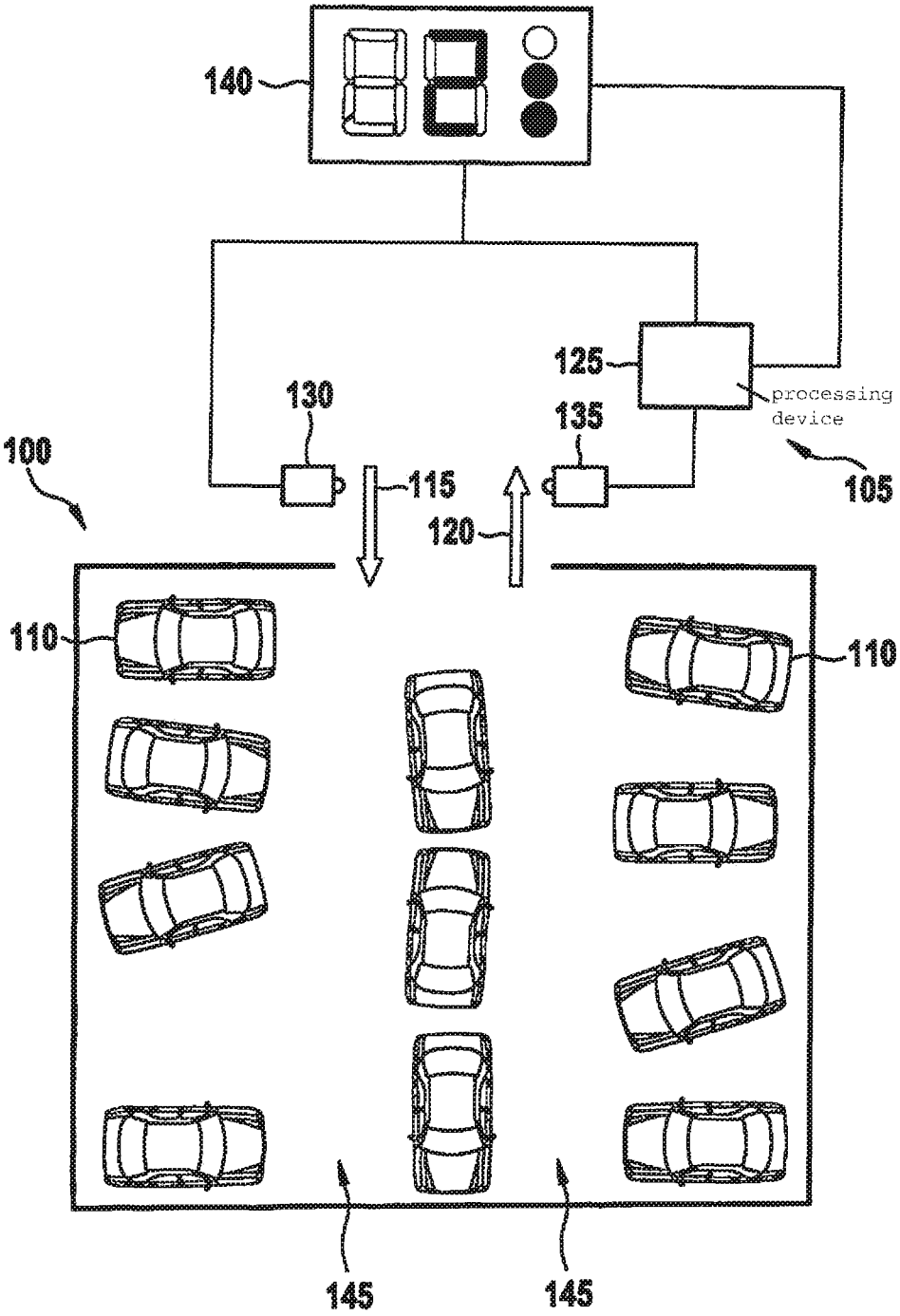
140
125
processing device
130
135
100
115
105
120
110
110
145
145

MANAGEMENT OF A PARKING LOT

FIELD

The present invention relates to the management of a parking lot. More specifically, the present invention relates to the management of a parking lot, which is set up for the parking of motor vehicles.

BACKGROUND INFORMATION

A parking lot is set up to accommodate a number of motor vehicles that are able to be parked there. The manner or the particular order in which the motor vehicles are to be parked inside the parking lot is not specified. In other words, the arrangement of motor vehicles in the parking lot may vary.

In contrast to an organized parking lot, where parking spaces that may be occupied by individual motor vehicles are identified, an unorganized parking lot is difficult to manage. In particular, it may be difficult to determine an additional number of motor vehicles still able to be parked in the parking lot at any given point in time.

An object of the present invention is to provide a technique for managing a parking lot that is set up for the parking of motor vehicles. Preferred specific embodiments are described herein.

SUMMARY

A parking lot is set up for the purpose of parking motor vehicles. A method for managing the parking lot includes steps of determining a maximum number of motor vehicles able to be parked in the parking lot, of counting arriving and departing motor vehicles, of determining a number of motor vehicles parked in the parking lot on the basis of the counted motor vehicles, and of determining a number of additional motor vehicles that are still able to be parked in the parking lot.

The counting of the arriving and departing motor vehicles requires only a modest investment in sensors, which are installed at entrance or exit ramps of the parking lot. There is no need to scan the entire parking space, e.g., using a camera installed at a greater height, or to provide a multitude of sensors for detecting individual motor vehicles inside the parking lot. The determination of the additional motor vehicles that may be parked in the parking lot may actually feature a degree of uncertainty, but a determination in a first approximation is frequently sufficient for many practical purposes. For example, a public parking space set up at a stop of a public mass transit system ("park and ride") is able to be managed in this manner. The determined number of additional motor vehicles that may be parked can be shown on a display board outside the parking lot, for instance.

The present method is particularly suitable for use in a parking lot for the unregulated parking of motor vehicles, where demarcations for parking spaces for the parking of individual motor vehicles are lacking. Here, the maximum number of motor vehicles parkable in the parking lot may be a function of a current occupancy situation, so that it should be checked on a regular basis.

Two different variants are possible for determining the maximum number. In a first variant, the maximum number is determined on the basis of a mean value of the vehicles parked inside the parking lot over time. By monitoring the determined number of motor vehicles parked in the parking lot, it is possible to find out at what point the parking lot is fully occupied. For example, this may be the case when the determined number of parked motor vehicles no longer changes despite the fact that fewer motor vehicles are driving inside the parking lot and an identical number of motor vehicles is leaving the parking lot.

In another variant, the maximum number is determined on the basis of a total available area of the parking lot and an assumed average size of a motor vehicle. This method may be easier in terms of processing technology. In addition, it is easier to take into account special circumstances, such as the loss of parking spaces when snow is cleared during the winter and is piled up in the area of the parking lot. Other influences such as a temporary closure of a section of the parking lot, perhaps due to construction work, are also easy to model.

In the area-based variant of determining the maximum number, access routes that are not available for the parking of motor vehicles are preferably taken into account. The area of the parking lot required for the access routes is able to be determined as a function of the occupancy degree.

The maximum numbers may exhibit a cyclical characteristic over time in both variants. For example, the maximum number in the winter may be lower than in the summer. Shorter cycles are also possible, for instance for weeks, days or hours. The determined maximum number with regard to an actual time is able to be established on the basis of the cycle. The determination accuracy of the method is able to be increased in this way.

In one further specific embodiment, the reliability of the determination of the number of additional motor vehicles able to be parked is ascertained. Since it is possible that the determined number may not precisely reflect reality, the reliability of the determination may affect the reliability of the determined number. The reliability of the determined number of additional motor vehicles able to be parked may be low especially when it represents a very small share of the maximum number of motor vehicles able to be parked in the parking lot. For example, if, in theory, one hundred motor vehicles may be parked in the parking lot, and it is determined that one further motor vehicle would still find room, then the probability of a correct statement is low. On the other hand, if it is determined that an additional eighty or ninety motor vehicles are still able to be parked, then the probability of an accurate statement is clearly greater. The reliability together with the number may be provided so that a driver in search of a location for parking his or her motor vehicle is given a better decision basis.

It is particularly preferred that the determined number of additional motor vehicles to be parked is made public in real time. In particular, the number may be displayed on a display board in the area of the parking lot or in the area of a street leading to the parking lot. In addition or as an alternative, the number may also be electronically communicated to the public, e.g., via a web service, via a radio broadcast, or via a cloud.

A computer program product includes program code for carrying out the afore-described method when the computer program product is running on a processing device or is stored on a computer-readable data carrier.

A device for managing the afore-described parking lot includes a first counting device for counting motor vehicles arriving in the parking lot, and a second counting device for counting motor vehicles leaving the parking lot. It also includes a processing device for determining a number of motor vehicles parked in the parking lot on the basis of the counted motor vehicles arriving and leaving. The processing device is set up to determine a number of additional motor vehicles that may be parked in the parking lot on the basis of the counted motor vehicles and a maximum number of motor vehicles able to be parked in the parking lot.

BRIEF DESCRIPTION OF THE DRAWINGS

FIG. 1 shows a parking lot equipped with a management device.

DETAILED DESCRIPTION OF EXAMPLE EMBODIMENTS

The present invention is described in greater detail below with reference to the FIGURE.

DETAILED DESCRIPTION OF EXAMPLE EMBODIMENTS

FIG. 1 shows a parking lot 100 equipped with a management device 105. Parking lot 100 is preferably set up for random parking, meaning that there is no rule or no specific rule as to where motor vehicles 110 able to be parked in parking lot 100 must park. In particular the width or length of a parking gap that a motor vehicle 110 may utilize may be undefined. A pattern according to which rows or some other arrangement of motor vehicles 110 are formed in parking lot 100 may also be freely selectable. Each driver of each motor vehicle 110 may render his or her contribution to forming an organizational structure.

Parking lot 100 includes an entrance 115 and an exit 120. In the representation shown, both coincide physically; however, they may also be provided separately from each other. In addition, there may be a plurality of entrances 115 and exits 120.

Management device 105 is set up to determine a number of additional motor vehicles that may still be parked in parking lot 100 at a given point in time. For this purpose, management device 105 includes a processing device 125, which is connected to a first counting device 130 for counting motor vehicles 110 entering parking lot 100, and to a second counting device 135 for counting motor vehicles 110 leaving parking lot 100. Each counting device 130, 135 may realize any type of scanning principle, for example using a light barrier, a camera, a radar or LIDAR sensor, using an induction loop, using ultrasound or a capacitance sensor. Based on the number of counted motor vehicles, processing device 125 determines how many motor vehicles 110 are located in parking lot 100.

Starting from a maximum number of motor vehicles 110 that may be parked in parking lot 100, a number of additional motor vehicles that are able to be parked in parking lot 100 is then able to be determined. For example, this number may be displayed graphically or numerically via display board 140. Alternatively or additionally, the determined number may also be made public in a digital manner, e.g., as a web service or in a cloud.

In order to determine the maximum number of motor vehicles 110 able to be parked in parking lot 100, an area of parking lot 100 may be divided by an average area required to park a motor vehicle 110. Preferably, the area of parking lot 100 is first reduced by the area of access routes 145 that are needed to prevent motor vehicles 110 from getting closed in. The available area of parking lot 100 may also be subject to fluctuations, e.g., if a section of parking lot 100 is unavailable for use because of stagnant water following a prolonged rainfall. A section of parking lot 100 may also be unusable due to snow that has been cleared and deposited in a part of parking lot 100, for example.

In another variant, the maximum number of motor vehicles 110 that can be parked in parking lot 100 is determined by monitoring the actual number of parked motor vehicles 110.

If parking lot 100 is completely occupied by motor vehicles 110, then typically the number of motor vehicles 110 located inside parking lot 100 no longer increases. An effect of drivers unsuccessfully searching for parking spaces and whose motor vehicles 110 are located in access areas 145 during that process may be considered negligible.

How well the determined number of additionally parkable motor vehicles 110 in parking lot 100 matches that of motor vehicles 110 actually still able to be parked in parking lot 100 usually depends on an occupancy degree of parking lot 100. In the exemplary illustration of FIG. 1, it was determined that two additional motor vehicles 110 can find space in parking lot 100. In FIG. 1, there is a corresponding gap in the row of parked motor vehicles 110 in the left area of parking lot 100 that may be occupied by an additional motor vehicle 110. On the right side, on the other hand, no gap is formed because adjacent motor vehicles 110 have an excessive clearance from one another in this particular row. The determined number Z therefore deviates by one from the actual number of motor vehicles 110 that are still able to be accommodated in the parking lot. This corresponds to an absolute error of only 1 but a relative error or 50%.

The lower the occupancy degree of parking lot 100, the greater the probability that a sufficiently small motor vehicle 110 will still be found that may use a remaining residual area that is smaller than the area required on average by a motor vehicle 110. However, if the occupancy degree of parking lot 100 approaches 100%, the possibilities for tight parking are virtually non-existent.

It is possible to determine a reliability or confidence at which the determined number of motor vehicles 110 still able to be parked in parking lot 100 is correct. In one further specific embodiment, it is also possible to determine a probability of the accuracy of the determined number. This value is able to be provided together with the determined number of additionally parkable motor vehicles 110. In the illustration of FIG. 1, an exemplary structure resembling a traffic light is shown on the right hand side of display board 140, which indicates how great the reliability of the determined and displayed value is. As an alternative to the symbolic display, a graphic display may also be used.

What is claimed is:

1. A method for managing a parking lot for parking motor vehicles, the method comprising:

determining, via a processor, a maximum number of motor vehicles able to be parked in the parking lot;

counting, via a sensor system, arriving and departing motor vehicles;

determining, via the processor, a number of motor vehicles parked in the parking lot based on the counted motor vehicles; and determining, via the processor, a number of motor vehicles that are additionally parkable in the parking lot;

wherein a reliability of the determination of the number of additional motor vehicles that are parkable is determined, and wherein the reliability and the number are provided to a driver so as to provide an improved basis for deciding where to park.

2. The method as recited in claim 1, wherein the parking lot is set up for unregulated parking of motor vehicles.

3. The method as recited in claim 1, wherein the maximum number is determined based on a mean value of the vehicles parked in the parking lot over time.

4. The method as recited in claim 1, wherein the maximum number is determined based on a total available area of the parking lot, and an assumed average size of a motor vehicle.

5. The method as recited in claim 4, wherein access routes are taken into account that are not available for the parking of motor vehicles.

6. The method as recited in claim 1, wherein the maximum number exhibits a cyclical characteristic over time, and the determined maximum number with regard to a current time is determined on the basis of the cycle.

7. The method as recited in claim 1, wherein the determined number of additional motor vehicles able to be parked is made public in real time.

8. A non-transitory computer-readable data carrier on which is stored a computer program, which is executable by a processor, comprising:

a program code arrangement having program code for managing a parking lot for parking motor vehicles, by performing the following:

determining, via the processor, a maximum number of motor vehicles able to be parked in the parking lot;

counting, via a sensor system, arriving and departing motor vehicles;

determining, via the processor, a number of motor vehicles parked in the parking lot based on the counted motor vehicles; and determining, via the processor, a number of motor vehicles that are additionally parkable in the parking lot;

wherein a reliability of the determination of the number of additional motor vehicles that are parkable is determined, and wherein the reliability and the number are provided to a driver so as to provide an improved basis for deciding where to park.

9. A device for managing a parking lot for parking of motor vehicles, comprising:

a non-transitory computer-readable data carrier on which is stored a computer program, which is executable by a processor, including a program code arrangement having program code for managing a parking lot for parking motor vehicles, by performing the following:

counting, via a sensor system, motor vehicles arriving in the parking lot;

counting, via the sensor system, motor vehicles leaving the parking lot; and determining, via the processor, a number of motor vehicles parked in the parking lot based on the counted arriving and departing motor vehicles;

wherein the processor is configured to determine a number of additional motor vehicles that are parkable in the parking lot based on the counted motor vehicles and a maximum number of motor vehicles that are parkable in the parking lot, wherein a reliability of the determination of the number of additional motor vehicles that are parkable is determined, and wherein the reliability and the number are provided to a driver so as to provide an improved basis for deciding where to park.

* * * * *